US005938015A

United States Patent [19]

Candy

[11] Patent Number: 5,938,015

[45] Date of Patent: Aug. 17, 1999

[54] NESTABLY STACKING CONTAINER WITH SEALED COMPARTMENT

[76] Inventor: Katrina Goff Candy, P.O. Box 367, Echuca Victoria, Australia, 3564

[21] Appl. No.: 08/916,535

[22] Filed: Aug. 19, 1997

[51] Int. Cl.[6] ..... B65D 77/20

[52] U.S. Cl. ..... 206/219; 206/217; 206/519; 206/553; 220/574.1

[58] Field of Search ..... 206/519, 217, 206/219, 553; 220/574.1

[56] References Cited

U.S. PATENT DOCUMENTS

| | | | |
|---|---|---|---|
| 4,039,435 | 8/1977 | Narva | 206/217 |
| 4,061,782 | 12/1977 | Baxter | 206/217 |
| 4,134,492 | 1/1979 | Lucas | 206/217 |

*Primary Examiner*—Joseph M. Moy

[57] ABSTRACT

A container which may be nestably stacked with a similar container, said container having:

a lip;

a base;

a sealing member situated between the lip and the base of the container to define a compartment within the container, said compartment being adapted to accommodate a product;

and a shank attached to the sealing member, said shank lying adjacent a wall of the container and passing from the sealing member to the lip of the container, the shank and sealing member being positioned so as to allow a similar container to be nested in the container, the sealing member being removable from the container by pulling an end of the shank adjacent to the lip of the container.

20 Claims, 6 Drawing Sheets

NESTABLY STACKING CONTAINER WITH SEALED COMPARTMENT

BACKGROUND

The present invention relates to a nestably stackable container adapted to have a product sealed therein.

Many products are sold or distributed in disposable containers, such as cups. Often, the product only occupies a small proportion of the volume of the container. Examples of products of this type are dehydrated soups or noodles; instant coffee, tea or chocolate; or pharmaceutical products. In sealing such products into the container, it is customary to place a seal at the lip of the container to prevent the product from either falling out of the container or being tampered with. This means that each container/product unit includes large amounts of empty space, making storage and shipping less efficient.

SUMMARY OF THE INVENTION

The present invention seeks to overcome or alleviate this problem by providing a sealed container which may be nestably stacked and which has a sealed compartment therein for containing a product.

Accordingly, there is provided a container which may be nestably stacked with a similar container, said container having a lip and a base; a sealing member which is situated between the lip and the base of the container to define a compartment within the container, said compartment being adapted to accommodate a product, whilst still allowing similar containers to be nested in the container, and a shank attached to the sealing member, said shank lying adjacent a wall of the container and passing from the sealing member to the lip of the container, so as to allow a similar container to be nested in the container, the sealing member being removable from the container by pulling at the end of the shank adjacent the lip of the container.

Preferably, the shank is hingedly connected to the edge of the sealing member.

In the invention, the shank and the sealing member may be locked into position relative to each other to form a spoon; the shank being adapted to form a handle and the sealing member being adapted to form the bowl of a spoon. Locking means are provided to hold the shank in a suitable position relative to the sealing member and enable use of the shank and sealing member as a spoon.

Preferably, the locking means comprise an arm having a first portion hingedly connected to the shank and a second portion connected at one end to the first portion and connected at a second end to a locking protrusion. The connection between the first portion of the arm and the second portion of the arm is preferably via an elbow, so that the first and second portions of the arm form an angle. The locking protrusion is preferably in the form of a spherical or cylindrical protrusion situated at the end of the arm remote from the shank.

The locking means further comprise a locking recess associated with the sealing member. The locking recess may be situated directly in the sealing member, but is preferably situated in a raised prominence on the sealing member. Preferably the raised prominence is in the form of a wedge, the broad end of the wedge facing the center of the sealing member and the narrow end of the wedge facing the edge of the sealing member. The locking recess is preferably adapted to receive the locking protrusion in a snap-fit fashion to improve the locking action of the locking means.

When the locking protrusion is placed within the locking recess, the arm forms a strut passing from the sealing member to the shank, holding the shank and the sealing member in position relative to each other.

In a particularly preferred form of the invention, the container comprises a disposable cup. The disposable cup may be formed of expanded polystyrene beads, plastic or the like. A sealing member in the form of a disc having a raised flange at its circumference is situated in the cup part way from the base of the cup to the lip of the cup. The raised flange on the circumference of the sealing member is adapted to abut closely against the walls of the cup, thereby forming a sealed compartment between the sealing member and the base of the cup. The sealing member may be held in the cup by a simple friction-fit; however, it is preferred if the sealing member is attached to the cup by a suitable adhesive. For applications in which the product to be sealed in the cup is a comestible or pharmaceutical product, the adhesive is desirably a non-toxic adhesive such as vegetable gum.

A shank, hingedly connected to the raised flanged on the sealing member runs from the sealing member to the lip of the cup adjacent a wall of the cup. It is preferred that the shank be integral with the sealing member and hingedly connected thereto via a live hinge. In a particularly preferred embodiment, the end of the shank adjacent the lip of the cup is provided with a flexible tab which passes over the lip of the cup to assist in locating the shank and pulling the shank so as to detach the sealing member from the walls of the cup.

Once the shank and sealing member have been removed from the cup, they may be used as a spoon. Locking means are provided to hold the shank relative to the sealing member so that it may be used as a spoon handle. The raised flange at the edge of the sealing member allows the sealing member to be used as the bowl of a spoon. The locking means comprise an arm which is hingedly connected to the shank part way along the length of the shank. Preferably, the arm is integral with the shank and is hingedly connected thereto by a live hinge. At the end of the arm distant from the shank, a locking protrusion is provided. The locking protrusion may be in the form of a spherical protrusion in which the diameter of the sphere is greater than the corresponding width of the arm or may be in the form of a cylinder set at right angles to the arm to form a T-shape with the end of the arm. A complementary locking recess is associated with the sealing member. By hingedly moving the shank relative to the sealing member and hingedly moving the arm relative to the shank, the locking protrusion may be placed in the locking recess, thereby preventing further movement of the shank relative to the sealing member. Preferably, the locking recess is provided with a mouth which is slightly smaller than the dimensions of the locking protrusion so that a snap-fit is obtained between the locking protrusion and the locking recess.

It is preferred that the locking recess is located in a raised prominence on the sealing member, both to assist a user in locating the locking recess and to provide extra thickness to ensure that the locking recess is sufficiently deep to engage the locking protrusion. The raised prominence is preferably in the form of a wedge, the broad end of the wedge facing towards the center of the sealing member and the narrow end of the wedge facing towards the circumference of the sealing member.

To assist in the further understanding of the invention, reference is now made to the accompanying drawings. These drawings show a preferred embodiment only and are not to be taken as limiting the scope of the invention as described above. In these drawings:

DESCRIPTION OF PREFERRED EMBODIMENTS

Figure 1:
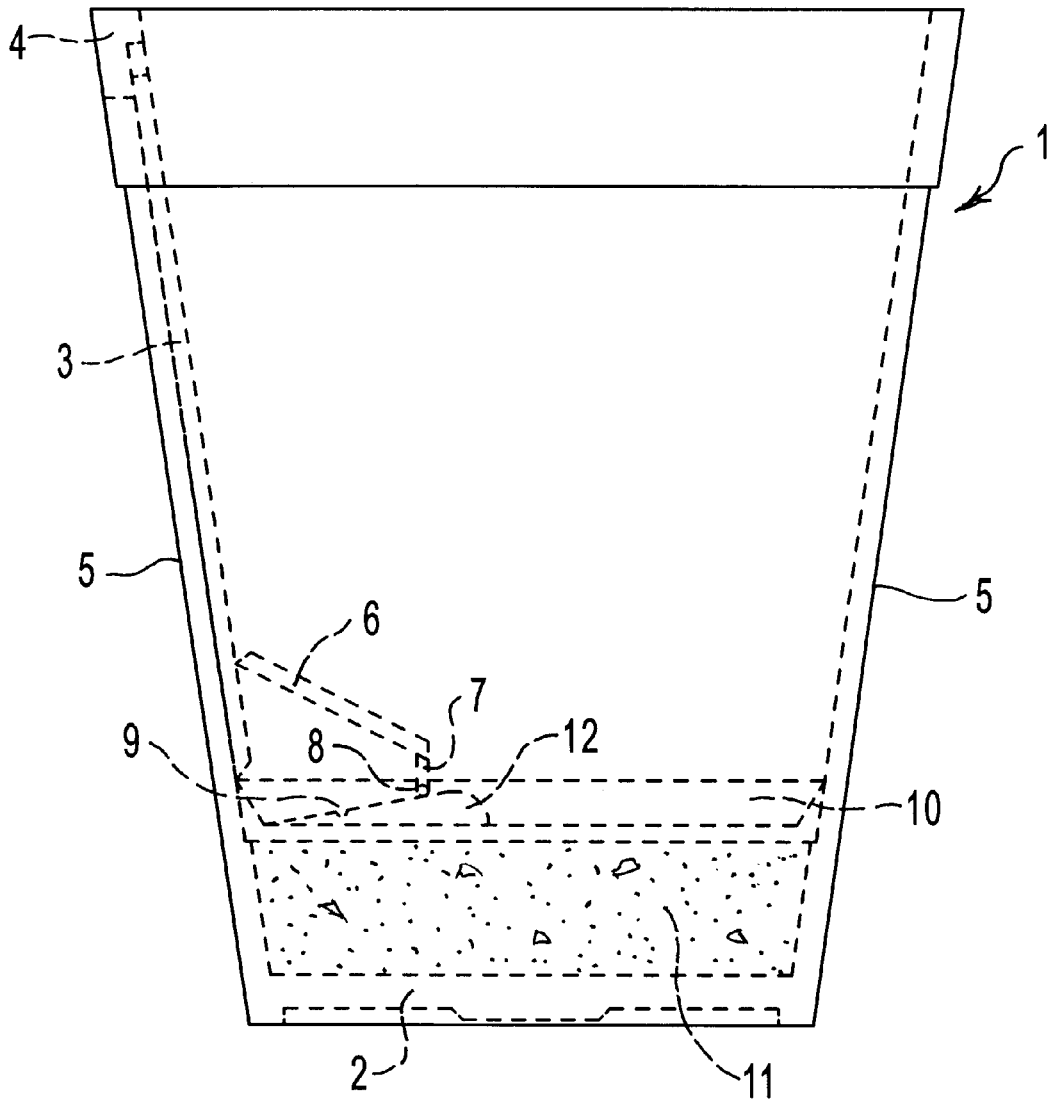
FIG. 1 is a cross sectional view of a cup in accordance with the invention.
Figure 2:
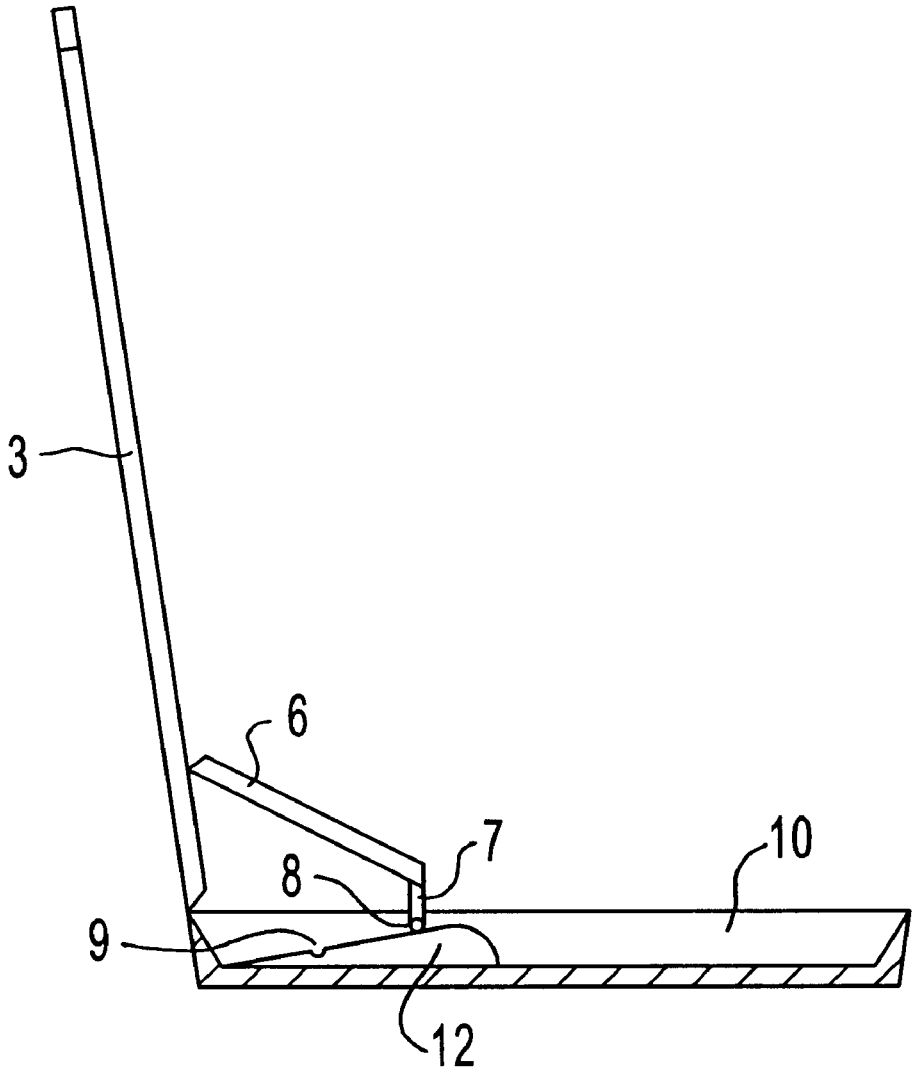
FIG. 2 is a cross sectional view of the sealing member, shank and locking means in the position of FIGS. 1+4.
Figure 3:
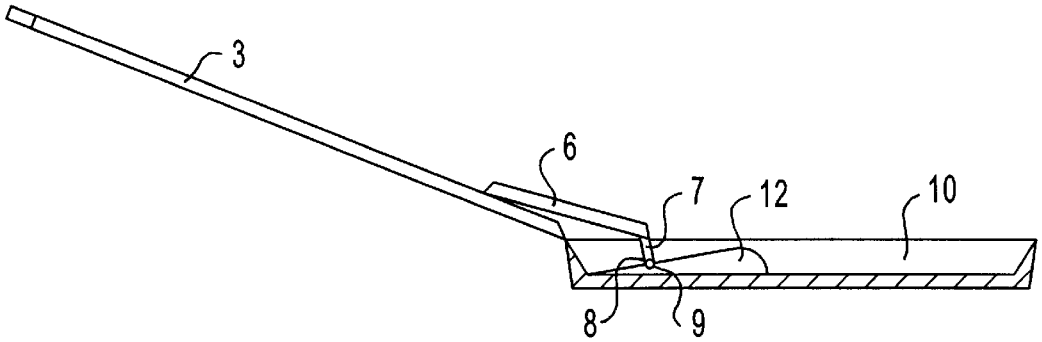
FIG. 3 is a cross sectional view of the sealing member, shank and locking means configured for use as a spoon.
Figure 4:
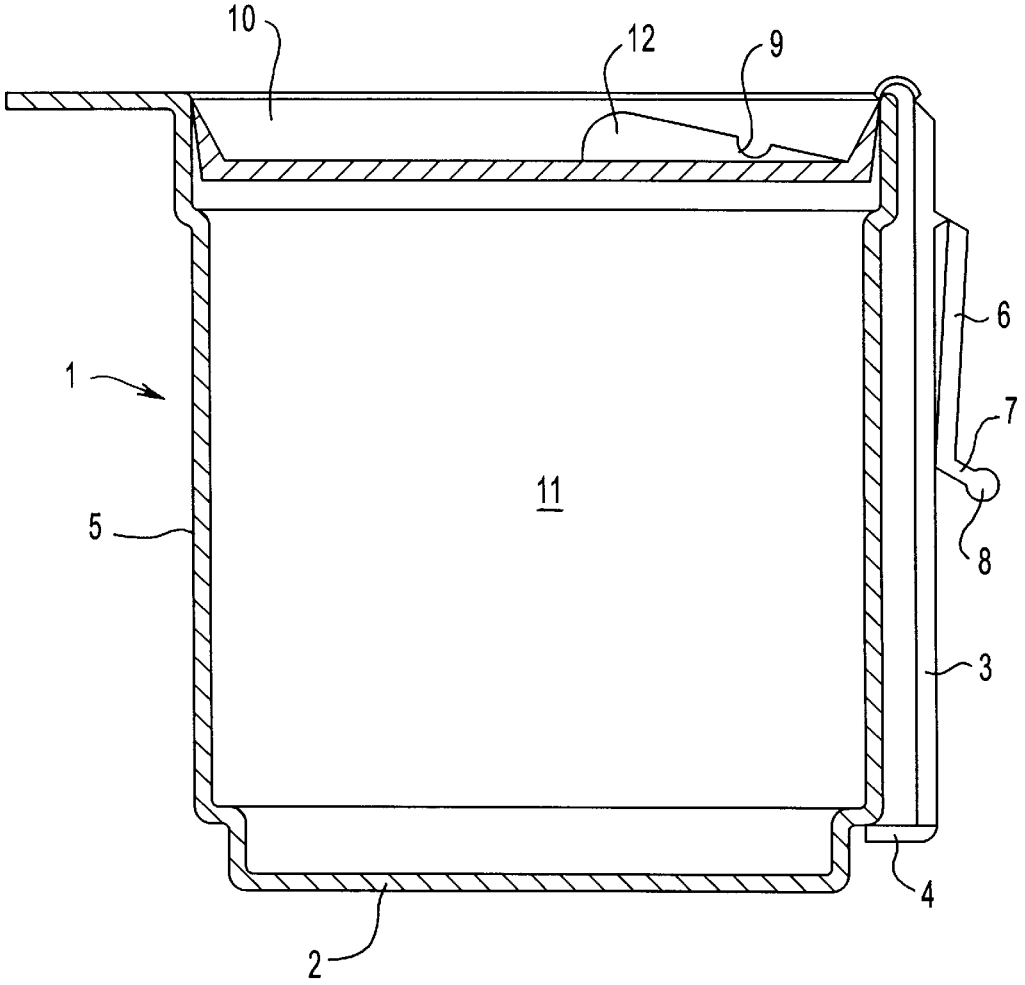
FIG. 4 is a cross sectional view of a container as a stackable variation of the invention.
Figure 5:
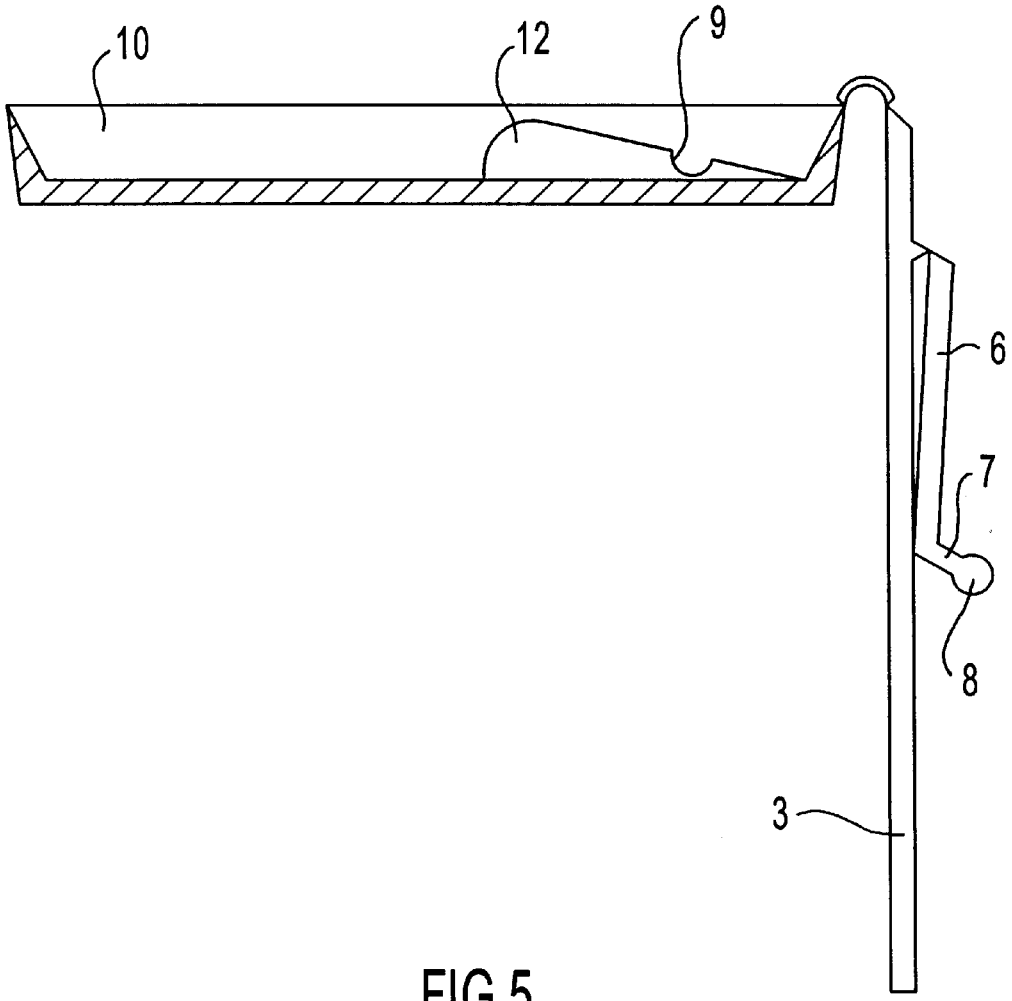
FIG. 5 is a cross sectional view similar to that of FIG. 2 showing the sealing member, shank and locking means of the container shown in FIG. 4.
Figure 6:
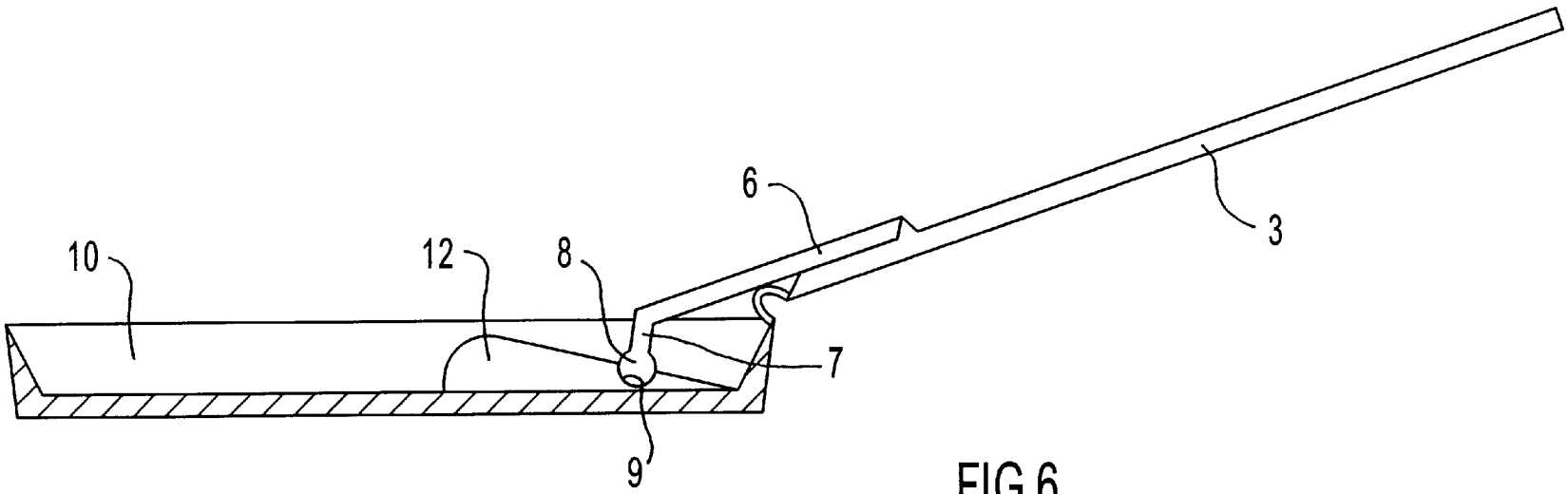
FIG. 6 is a cross sectional view of the sealing member, shank and locking means of FIG. 5 configured for use as a spoon.

In FIGS. 1–3 of the first embodiment and FIGS. 4–6 of the second embodiment, the same reference numerals are used to denote corresponding features.

The preferred form of the invention shown in the drawings also includes a cup 1 having a base 2 and walls 5. Sealing member 10 is placed in cup 1 so as to abut walls 5 and seal product 11 within cup 1. A shank 3 passes from sealing member 10 to the lip of cup 1 and is preferably marked with a tab indicator 4 for ease of use. In use, tab indicator 4 is used to remove shank 3 from wall 5 so that shank 3 may be pulled, thereby removing sealing member 10 from the cup 1 and allowing access to product 11. Once removed from cup 1, shank 3 is moved into position shown in FIG. 3 whilst an arm having a first portion 6 and a second portion 7 which is hingedly connected to shank 3 is moved so that locking protrusion 8 engages locking recess 9 situated in raised prominence 12.

Preferably, the arm is constructed so that first portion 6 abuts against shank 3 when locking protrusion 8 is placed in locking recess 9 so as to prevent further movement of shank 3 relative to sealing member 10 and provide further rigidity to the lower portion of shank 3. As will be evident from a comparison of FIGS. 1 and 4, in the first embodiment (FIG. 1) the shank 3 of the sealing member 10 extends from the edge of the sealing member 10 adjacent the inner surface of wall 5 and terminates at an end near the lip of cup 1. In the second embodiment (FIG. 4) the shank 3 extends from the edge of sealing member 10 over the lip of container 1 and downwardly adjacent the outside surface of wall 5.

It is to be understood that various other modifications and/or alterations may be made without departing from the spirit of the invention as outlined herein.

I claim:

1. A container which is nestably stackable with a similar container, the container comprising:

a base, a side wall extending from the base and defining an upper lip of the container, a sealing member situated between the lip and the base to define a compartment within the container, the compartment being adapted to accommodate a product, a shank attached to the sealing member and extending therefrom adjacent the inner surface of said wall and terminating at an end near the lip of the container, the shank and the sealing member being positioned so as to allow a similar container to be nested in the container, the sealing member being removable from the container by applying a pulling force to the end of the shank, wherein the shank and the sealing member include locking means for locking the shank in a position relative to the sealing member for the shank and sealing member to form a spoon upon removal thereof from the container, wherein the shank forms a handle and the sealing member forms a bowl of the spoon.

2. A container as claimed in claim 1 wherein the shank is attached to the sealing member by a hinge connection between the shank and an edge of the sealing member.

3. A container as claimed in claim 2 wherein the sealing member is in the form of a disc and has a raised flange around its circumference, wherein the flange abuts the inner surface of the wall of the container to provide said compartment.

4. A container as claimed in claim 2 wherein the locking means comprise an arm associated with the shank and a structure defining a recess associated with the sealing member, wherein an end of the arm is attached to the shank by a hinge connection and the arm has a protrusion at its free end, wherein the protrusion is engageable in the recess of the structure associated with the sealing member for the arm to form a strut between the sealing member and the shank.

5. A container as claimed in claim 4 wherein the protrusion and the recess are dimensioned such that the protrusion is a snap-fit in the recess.

6. A container as claimed in claim 4 wherein the structure associated with the sealing member is a raised prominence on the sealing member.

7. A container as claimed in claim 6 wherein the raised prominence is wedge-shaped having an upstanding end portion and a surface which slopes therefrom towards the sealing member, wherein the sloping surface slopes towards the edge of the sealing member.

8. A container as claimed in claim 4 wherein the arm comprises a first portion and a second portion, the first portion being attached to the shank and the second portion having the protrusion, wherein the second portion of the arm extends from the first portion of the arm at an angle.

9. A container as claimed in claim 8 wherein the angle is such that when the protrusion is engaged in the recess, the first portion of the arm abuts along a portion of the shank.

10. A container as claimed in claim 9 wherein the sealing member, shank and locking means are integrally formed.

11. A container which is stackable with a similar container, the container comprising:

a base, a side wall extending from the base and defining an upper lip of the container, a sealing member situated between the lip and the base to define a compartment within the container, the compartment being adapted to accommodate a product, a shank attached to the sealing member and extending therefrom over the lip and lying adjacent to the outer surface of said wall and terminating at an end near the base of the container, the shank and the sealing member being positioned so as to allow a similar container to be stacked in the container, the sealing member being removable from the container by applying a pulling force to the end of the shank, wherein the shank and the sealing member include locking means for locking the shank in a position relative to the sealing member for the shank and sealing member to form a spoon upon removal thereof from the container, wherein the shank forms a handle and the sealing member forms a bowl of the spoon.

12. A container as claimed in claim 11 wherein the shank is attached to the sealing member by a hinge connection between the shank and an edge of the sealing member.

13. A container as claimed in claim 12 wherein the sealing member is in the form of a disc and has a raised flange around its circumference, wherein the flange abuts the inner surface of the wall of the container to provide said compartment.

14. A container as claimed in claim 12 wherein the locking means comprise an arm associated with the shank and a structure defining a recess associated with the sealing member, wherein an end of the arm is attached to the shank by a hinge connection and the arm has a protrusion at its free end, wherein the protrusion is engageable in the recess of the structure associated with the sealing member for the arm to form a strut between the sealing member and the shank.

15. A container as claimed in claim 14 wherein the protrusion and the recess are dimensioned such that the protrusion is a snap-fit in the recess.

16. A container as claimed in claim 14 wherein the structure associated with the sealing member is a raised prominence on the sealing member.

17. A container as claimed in claim 16 wherein the raised prominence is wedge-shaped having an upstanding end portion and a sloping surface which slopes therefrom towards the sealing member, wherein the sloping surface slopes towards the edge of the sealing member.

18. A container as claimed in claim 14 wherein the arm comprises a first portion and a second portion, the first portion being attached to the shank and the second portion having the protrusion, wherein the second portion of the arm extends from the first portion of the arm at an angle.

19. A container as claimed in claim 18 wherein the angle is such that when the protrusion is engaged in the recess, the first portion of the arm abuts along a portion of the shank.

20. A container as claimed in claim 19 wherein the sealing member, shank and locking means are integrally formed.

* * * * *